US006748676B1

(12) United States Patent
Chenevert

(10) Patent No.: US 6,748,676 B1
(45) Date of Patent: Jun. 15, 2004

(54) SPORT FOOTWEAR COMPONENT CONSTRUCTION

(75) Inventor: François Chenevert, Blainville (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/467,523

(22) Filed: Dec. 21, 1999

(30) Foreign Application Priority Data

Dec. 22, 1998 (CA) ..... 2256917

(51) Int. Cl.[7] ..... A24F 27/00

(52) U.S. Cl. ..... 36/115; 36/117.6; 36/97; 36/93; 36/10; 36/55

(58) Field of Search ..... 36/115, 116, 117.6, 36/102, 97, 88, 93, 10, 55, 45, 71, 43–44, 100, 101

(56) References Cited

U.S. PATENT DOCUMENTS

| | | | | | |
|---|---|---|---|---|---|
| 2,537,156 | A | | 1/1951 | Pennell | |
| 3,333,353 | A | | 8/1967 | Garcia | |
| 3,419,974 | A | * | 1/1969 | Lange | 36/55 |
| 3,640,003 | A | * | 2/1972 | Anderson | 12/142 P |
| 3,858,337 | A | * | 1/1975 | Vogel | 36/55 |
| 3,977,098 | A | * | 8/1976 | Chalmers | 36/136 |
| 4,346,525 | A | | 8/1982 | Larsen et al. | |
| 4,353,173 | A | | 10/1982 | Paquet | |
| 4,510,700 | A | | 4/1985 | Brown | |
| 4,523,392 | A | * | 6/1985 | Gabrielli | 36/10 |
| 4,542,598 | A | | 9/1985 | Misevich et al. | |
| 4,747,221 | A | * | 5/1988 | Hayes | 36/119 |
| 4,782,605 | A | | 11/1988 | Chapnick | |
| 4,800,657 | A | | 1/1989 | Brown | |
| 4,813,157 | A | * | 3/1989 | Boisvert et al. | 36/44 |
| 4,869,001 | A | | 9/1989 | Brown | |
| 5,083,385 | A | * | 1/1992 | Halford | 36/101 |
| 5,146,698 | A | | 9/1992 | Tilles et al. | |
| 5,154,682 | A | * | 10/1992 | Kellerman | 36/44 |
| 5,259,126 | A | * | 11/1993 | Rosen | 36/93 |
| 5,275,775 | A | | 1/1994 | Riecken | |
| 5,339,544 | A | | 8/1994 | Caberlotto | |
| 5,517,770 | A | * | 5/1996 | Martin et al. | 36/43 |
| 5,544,432 | A | | 8/1996 | Kita | |
| 5,570,523 | A | * | 11/1996 | Lin | 36/112 |
| 5,572,805 | A | * | 11/1996 | Giese et al. | 36/103 |
| 5,659,979 | A | * | 8/1997 | Sileo | 36/54 |
| 5,669,162 | A | | 9/1997 | Dyer | |
| 5,746,011 | A | | 5/1998 | Hedström | |
| 5,778,562 | A | | 7/1998 | Karl-Heinz | |
| 5,933,984 | A | | 8/1999 | Carlson et al. | |
| 6,050,004 | A | * | 4/2000 | Miralles et al. | 36/97 |
| 6,082,027 | A | * | 7/2000 | Wagonhurst | 36/97 |

FOREIGN PATENT DOCUMENTS

FR 2763220 A1 * 11/1998

* cited by examiner

*Primary Examiner*—Jila M. Mohandesi
(74) *Attorney, Agent, or Firm*—RatnerPrestia

(57) ABSTRACT

A footbed for sport footwear made of a shell, which defines the general shape of the footwear. The footbed has a sole portion and a padding wall for partially separating the sides and back of a wearer's foot from the shell. The padding wall partially cups the wearer's heel and extending from the back of the wearer's foot along each side of the heel, along each side of the midfoot and along each side of the forefoot. The footbed is adapted for determining the size of the footwear in terms of width. The footbed may further comprise a toe wall portion for determining the size of the footwear in terms of length.

11 Claims, 6 Drawing Sheets

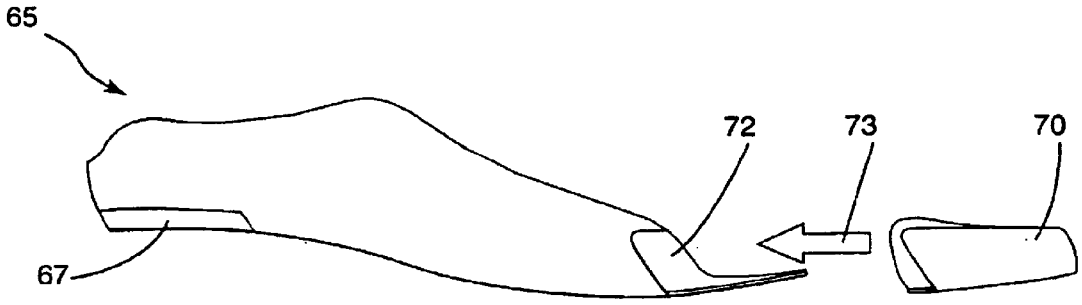
Fig.-11a
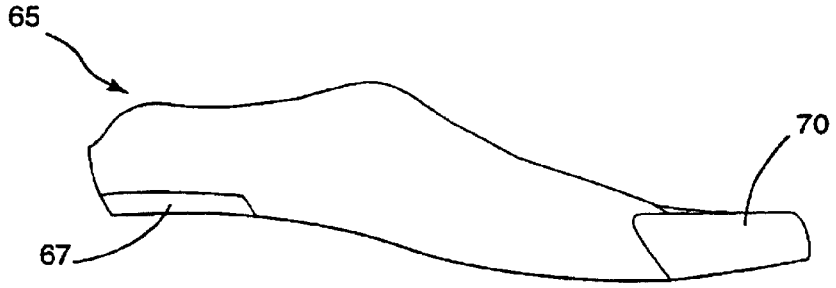
Fig.-11b
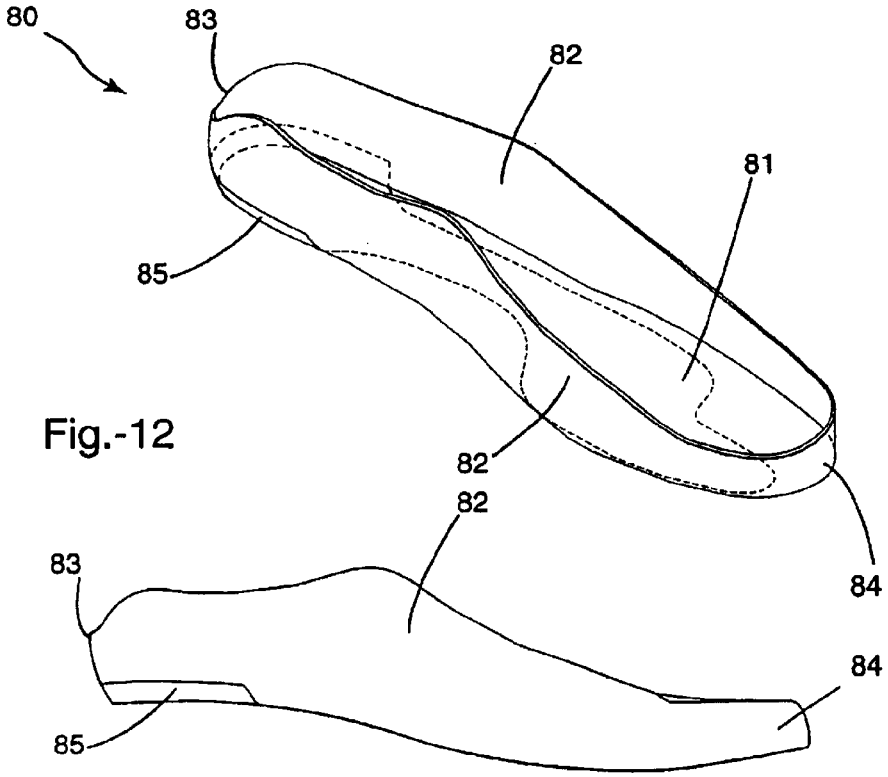
Fig.-12
Fig.-13

SPORT FOOTWEAR COMPONENT CONSTRUCTION

FIELD OF THE INVENTION

The invention relates generally to the art of making sports and athletic footwear including skate boots suitable for use on ice skate blade or on in-line roller skate chassis. The invention relates in particular to a footbed which is a particular sport footwear components that receives the foot of the wearer inside the footwear for providing the required degree of comfort and support.

BACKGROUND OF THE INVENTION

Traditionally, skate boots and footwear in general, are constructed over a last of a specific shoe size. A last is a three-dimensional shape of the inside walls of the footwear on which the upper of the footwear is formed. Once the upper is completed, an outer sole is glued or nailed to the upper and an insole covering the entire plantar surface of the foot is inserted into the upper to provide the cushioning means of the footwear. A typical insole may incorporate sidewalls, which surrounds the heel in order to center the foot inside the footwear and a small bulge in the midfoot area adapted to support the inside arch of the foot.

A wide array of insole designs has been introduced to increase the level of comfort and support afforded by a footwear, some of which are disclosed in U.S. Pat. No. 5,544,432, U.S. Pat. No. 5,778,562, U.S. Pat. No. 4,800,657, U.S. Pat. No. 4,510,700, U.S. Pat. No. 5,146,698, and U.S. Pat. No. 2,537,156.

In general, sport footwear are either made traditionally over a last and incorporate an innersole covering the plantar surface of the foot or are made of a molded plastic shell combined with an inner soft boot completely enclosing the foot and portion of the ankle and lower leg.

U.S. Pat. No. 5,339,544 discloses an athletic shoe such for football, soccer and track and field shoe constructed of a rear molded plastic shell and a front upper made of soft material joined together at the mid-section. A lining, which protrudes from the front upper, is inserted into the rear shell when the two parts are assembled providing the necessary cushioning means. An insole is inserted into the shoe, covering the foot-resting region. This type of shoe construction also allows the used of a rear shell for a range of shoe size. The rear shell may be used with front uppers of different length and width thereby minimizing the number of shells needed to put on the market a full range of sizes of a specific footwear product line. The shortcoming of this construction is that an insole, a front upper and a lining are required for each shoe size.

In light of these various designs, there is a need for a footbed adapted for a footwear construction comprising a molded plastic shell or for a traditionally made footwear capable of defining the size of the footwear so constructed while providing the necessary level of support and comfort for the sporting activity the footwear is designed for.

OBJECTS AND STATEMENT OF THE INVENTION

It is thus an object of the invention to provide a footbed adapted for determining the size of a sport footwear in terms of width.

It is another object of the invention to provide a footbed adapted for determining the size of a sport footwear in terms of length.

It is a further object of the invention to provide a footbed capable of supporting the foot according to the sporting activity the footwear is designed for.

As embodied and broadly described herein, the invention provides a footbed for use in a sport footwear having a foot receiving cavity. The footbed receives a wearer's foot and provides foot support and comfort. The footbed comprises a sole portion having an upper surface generally following the contour of the plantar surface of a wearer's foot; and a padding wall for separating the lower portion of the sides and heel of a wearer's foot from the foot receiving cavity. The padding wall partially cups the wearer's heel and extends from the back of the wearer's foot along each side of the heel, along each side of the midfoot and along each side of the forefoot up to the roots of the toes. The footbed fits closely within the foot receiving cavity and the padding wall of the footbed are so constructed as to determine the size of sport footwear in terms of width. Advantageously, the padding wall also extends upwardly from the sole portion at least up to extending upwardly from said sole portion at least up to a medial line defined by the bones of the foot.

Furthermore, a variation of thickness of the padding wall modifies the width of the sport footwear. Advantageously, the footbed further comprises a toe wall portion for determining the size of the sport footwear in terms of length, wherein a variation of thickness of the toe wall portion modifies the length of the sport footwear. The toe wall portion can be a separate part or be integral to said padding wall.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which:

FIG. 11*a* is a side elevational view of the footbed shown in FIG. 8;

FIG. 11*b* is a side elevational view of the footbed shown in FIG. 8 with the frontal part of the footbed installed;

FIG. 12 is a perspective view of a footbed according to a third embodiment of the invention;

FIG. 13 is a side elevational view of the footbed shown in FIG. 12;

Figure 1:
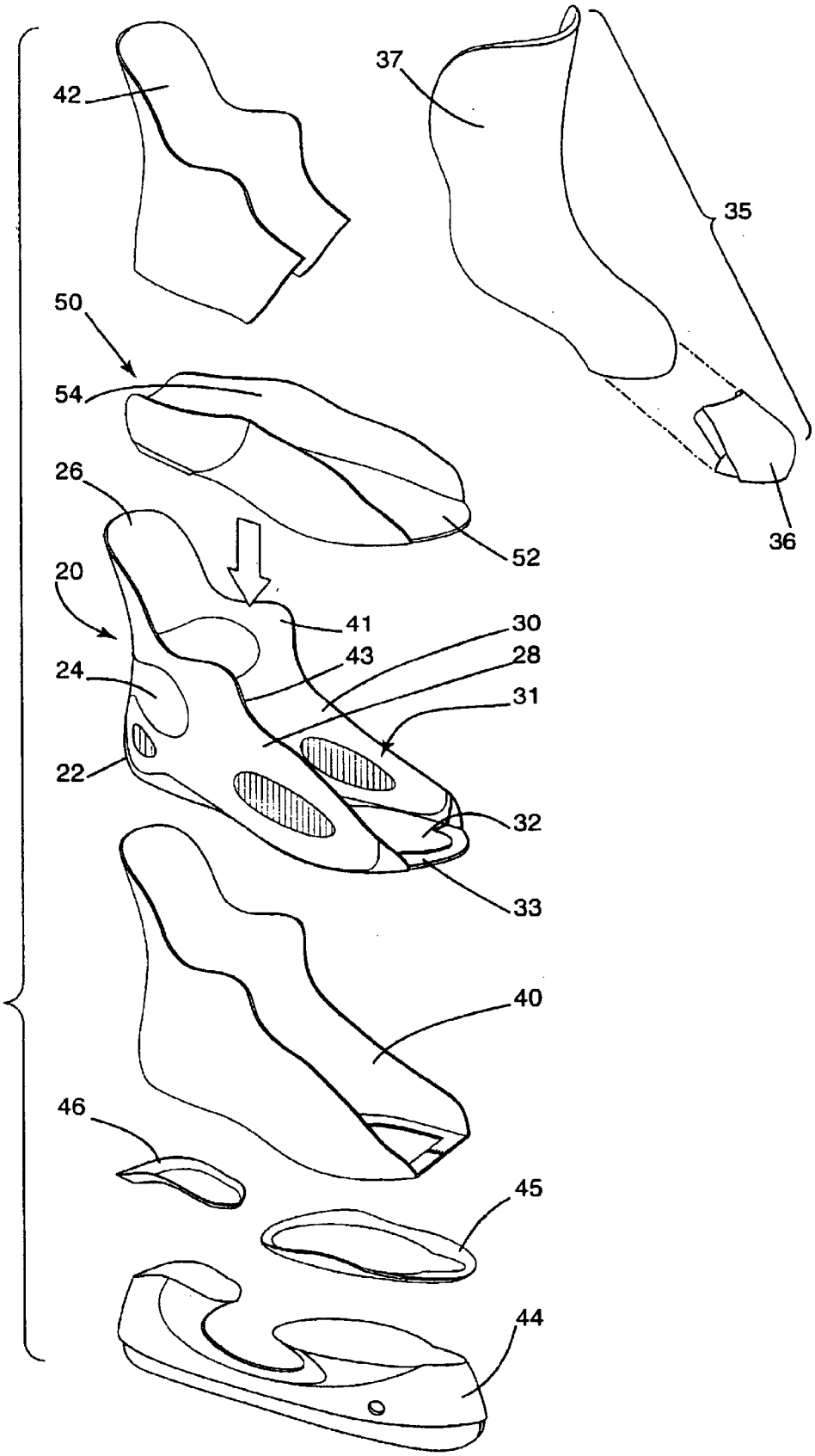
FIG. 1 is an exploded view of an ice skate which has a footbed according to one embodiment of the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIG. 1 is an exploded view of an ice skate having a molded plastic shell 20 as the main structural element. Shell 20 comprises a heel counter 22, an ankle counter 24, which surrounds the foot's malleolis, a tendon guard 26, a medial quarter 28 and a lateral quarter 30 extending longitudinally from heel and ankle counter 22 and 24, to the front of shell 20. A sole 32 extends the entire length of shell 20 and joins together quarters 28 and 30. Quarters 28 and 30 together define the opening of the skate boot for insertion and removal of the foot. Quarters 28 and 30 together with heel counter 22 and sole 32 define a foot receiving cavity 31. Sole 32 further comprises a receptacle groove 33 adapted to receive a toe-box/tongue assembly 35 made of toe box 36 and tongue 37. In the illustrated arrangement, the frontal portion of shell 20 in the toe area is open. Shell 20 could easily be closed at the toe area so that the toe box 36 would be integral with shell 20.

The ice skate further comprises a skin 40 which snugly fits over shell 20 and is glued thereto and a ice runner holder assembly 44 which is mounted to the bottom of the assembled skate boot. A pair of gaskets 45 and 46 are positioned between ice runner holder assembly 44 and the assembled skate boot to fill any gap that may be left between the two components and increase their frictional engagement.

A lining 42 is affixed into the rear upper portion of shell 20 covering and cushioning tendon guard 26, ankle counter 24 and the side walls of heel counter 22. The contours of lining 42 follows edges 41 and 43 of quarters 28 and 30 down to about the mid section of shell 20. Toe-box/tongue assembly 35 is installed over shell 20 by gluing or otherwise fastening toe box 36 into receptacle groove 33, thereby closing the front portion of shell 20. Finally, a footbed 50 is inserted into the assembled skate. Footbed 50 comprises a sole portion 52 and a padding wall 54 surrounding the heel and sides of the foot up to the toe area. Sole portion 52 underlies the entire surface defined by the foot, including the toe area.

Figure 2:
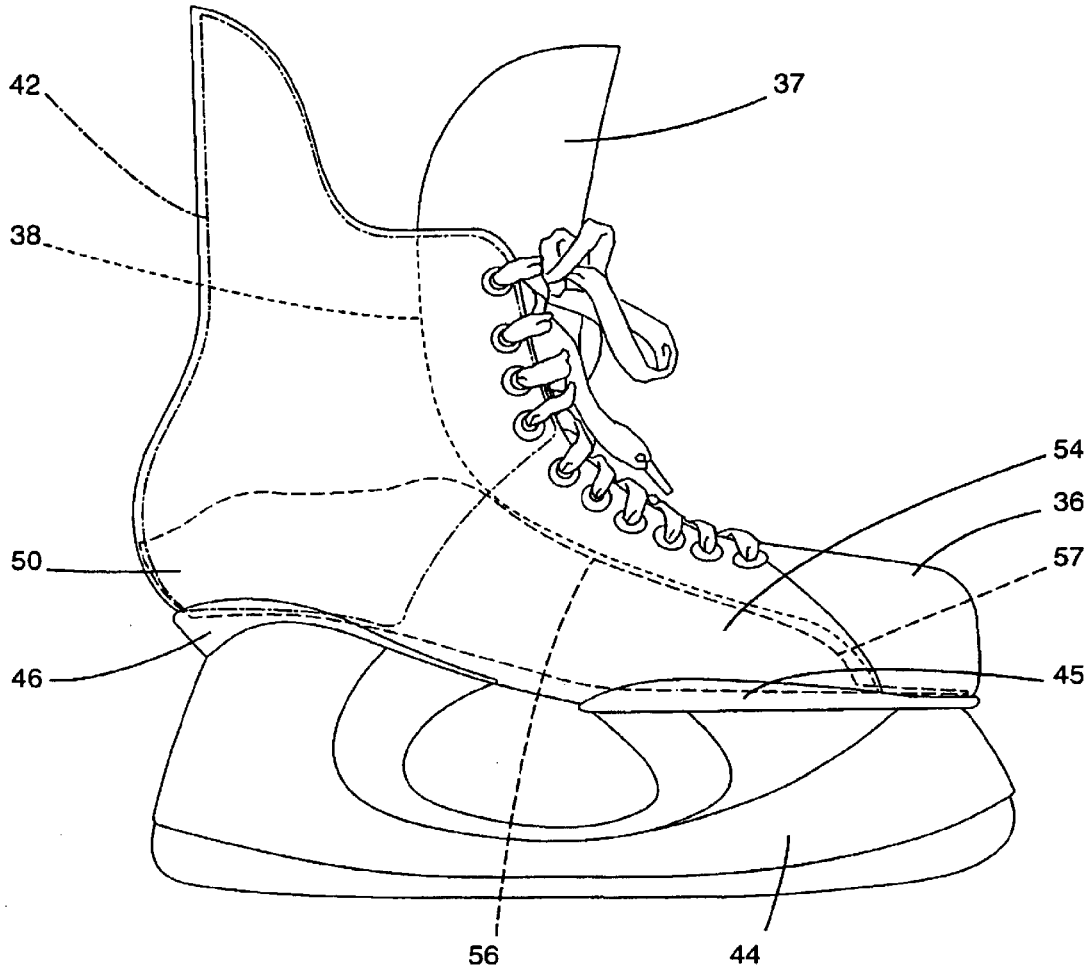
FIG. 2 is a side elevational view of an ice skate with a footbed according to one embodiment of the invention in position therein.

Therefore, the interior volume of the skate is defined and determined by the combination of lining 42, footbed 50 and toe-box/tongue assembly 35. FIG. 2 is a side elevational view of the assembled skate showing how lining 42, footbed 50 and toe-box/tongue assembly 35 cooperate to define the interior volume of the skate boot in which the foot is received. As illustrated, tongue 37 extends down into toe box 36 to reach the front portion of footbed 50. Inside edge 38 of tongue 37 closely follows the frontal edge 57 of padding wall 54. The soft material of tongue 37 covers the inner surface of toe box 36 down to the front portion of footbed 50. The back portion of padding wall 54 overlaps lining 42 leaving no gap between footbed 50 and lining 42. Tongue 37 also overlaps lining 42 at the front upper area of the skate. Tongue 37 juxtaposed to footbed 50 and lining 42 overlapping both footbed 50 and tongue 42 thereby define the volume and therefore the size of the skate boot.

In the footwear industry, there are three sizes per inch and each size is divided into half sizes. For a given size, there are as much as six width sizes labelled "B", "C", "D", "E", "EE", "EEE". The narrowest sizes being a "B" and the largest being a "EEE". The most common width sizes are the middle range "D", "E", and "EE". For the purpose of the description only the most common width sizes are illustrated and referred to, however it is understood that all sizes are included within the scope of the invention. The width variation between feet of substantially equal length occurs mostly in the midfoot and forefoot area; the heel's width remaining fairly constant. Furthermore, the heel and ankle's position relative to the footwear also remains almost constant between feet of one size and the following size. For instance, the position of the heel and ankle of a size 8 relative to the footwear is almost identical to the relative position of a size 8½. The only noticeable variation can be attributed to normal physiological variation between humans, as two feet are never exactly the same. We therefore assume that the midfoot and forefoot (the portion of the foot ahead of the ankle) is the general area where most of the variations of length and width of feet of similar size occurs.

Figure 3:
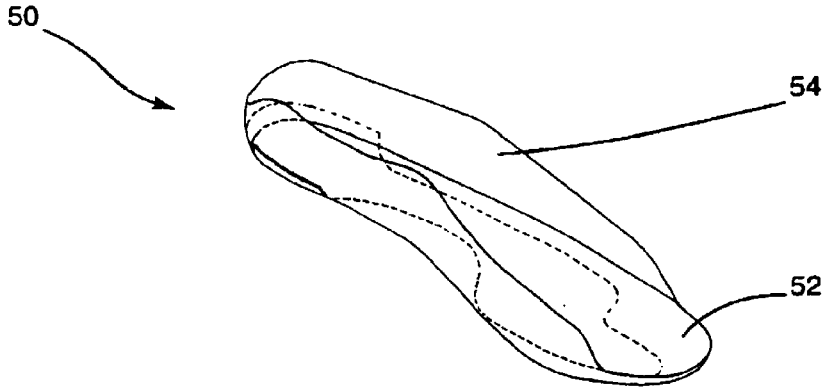
FIG. 3 is a perspective view of a footbed according to one embodiment of the invention.

For a given shell 20, It is possible to utilize footbed 50 to adjust the width of the skate boot to accommodate feet of different width by varying the thickness of padding wall 54. FIG. 3 illustrates footbed 50 in isolation. Footbed 50 comprises a sole portion 52 and a padding wall 54 extending along both sides of sole 52. Padding wall 54 is higher than typical insoles normally used and surrounds and cushions most of the sides of the foot. Padding wall 54 in combination with sole portion 52 provides an envelope for the foot which is comfortable yet offers a supporting "bed" that maintains the foot in its required position inside the footwear it is inserted into for optimal performance.

Padding wall 54 separates the lower portion of the sides and heel of a wearer's foot from the foot receiving cavity 31. Padding wall 54 partially cups the wearer's heel and extends from the back of the wearer's foot along each side up to the roots of the toes. Padding wall 54 extends upwardly up to a medial line defined by the bones of the foot. The medial line corresponds generally to the middle of the bony prominence of the bone structure of the foot.

Figure 4:
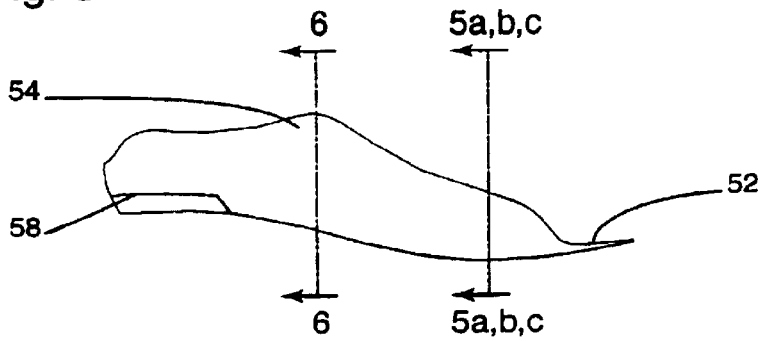
FIG. 4 is a side elevational view of the footbed shown in FIG. 3.

The outer configuration of footbed 50 is designed to mate with the interior shape of a given shell 20. As shown in FIGS. 3 and 4, the outer portion of footbed 50 features a heel portion 58 having sharp edges adapted to properly position footbed 50 into shell 20. The heel area inside shell 20 comprises a similar profile. When footbed 50 is inserted into shell 20, it is forced into the specific position defined by these mating surfaces.

Figure 5A:
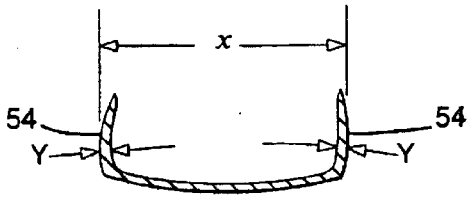
FIGS. 5*a*, 5*b* and 5*c* are cross-sectional views of the footbed shown in FIG. 4 taken at line 5—5.
Figure 5B:
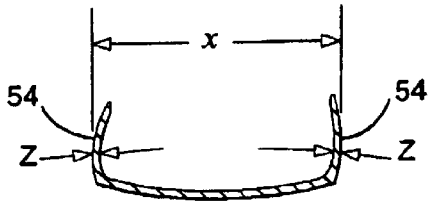
Figure 5C:
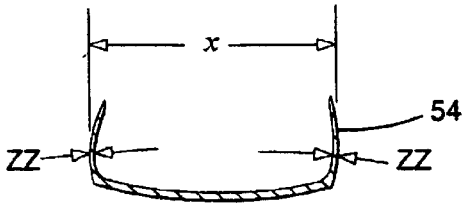

As shown in FIGS. 5*a*, 5*b*, and 5*c*, which are cross section of footbed 50 taken at line 5—5 of three different footbeds 50, the external dimension "X" representing the outer width of footbed 50 remains constant for all three sizes so that the three footbeds 50 fit into the same shell 20 which also has a constant internal width. FIG. 5*a* illustrates a width size "D" which is the smallest width of the three sizes illustrated. The thickness "Y" of padding wall 54 is such as to define an interior width of a footbed 50 corresponding to a size "D". FIG. 5*b* illustrates a width size "E" which is an intermediate width size. Thickness "Z" of padding wall 54 is smaller than thickness "Y" of size "D" shown in FIG. 5*a*. The thickness "Z" of padding wall 54 defines an interior width of a footbed 50 corresponding to a size "E". FIG. 5*c* illustrates a width size "EE" which is a large width size. Thickness "ZZ" of padding wall 54 is smaller than both thicknesses "Y" and "Z" of size "D" and "E" shown in FIGS. 5*a* and 5*b*. The thickness "ZZ" of padding wall 54 defines an interior width of a footbed 50 corresponding to a size "EE". It is important to note that although only a cross-section taken at line 5—5 is shown, the variation of thickness of padding wall 54 is spread over the entire length of padding wall 54. Therefore, for a given size of shell 20, the three foot sizes "D", "E", and "EE" can be accommodated by simply inserted the corresponding footbed 50.

Figure 6:
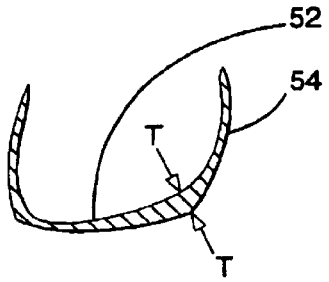
FIG. 6 is a cross-sectional views of the footbed shown in FIG. 5 taken at line 6—6.

FIG. 6 is a cross-section of footbed 50 taken at line 6—6 of FIG. 3 showing the increased thickness T—T of sole portion 52 and padding wall 54 in the arch area of the foot. The thickness in this area also varies with the various width sizes "D", "E", and "EE" while the external dimension of footbed 50 remains constant.

One important advantage of using footbed 50 to adjust the width size of the skate boot is that the support provided by shell 20 does not vary. Lining 42 is the same for all width sizes so that the ankle support provided by a footwear size "D" for example is exactly the same as that provided by a size "EE".

It is also possible to utilize tongue 37 to adjust the inside length of the skate boot by varying its thickness. Since tongue 37 covers the entire inner surface of toe box 36, adjusting its thickness in this area reduces or increases the shoe size of the skate boot. The variation of its thickness provides sufficient adjustment to vary the shoe size by half a point. For a given shell 20 having a given footbed 50, a size 8½ for instance, may be reduced to a size 8 simply by installing a tongue 37 having a thicker portion in the vicinity of toe box 36.

With the combinations of three footbeds 50 sizes "D", "E", and "EE", and two tongues 37 of two different thicknesses, shell 20 may accommodate up to six sizes: two lengths and three widths per length. The versatility of sizes of shell 20 is achieved without compromising the foot and ankle support provided by shell 20.

Footbed 50 may also be used with a traditionally made skate boot having a specific inner volume. The benefits of using footbed 50 are the same. A given skate boot may be used to accommodate up to six sizes.

Figure 7:
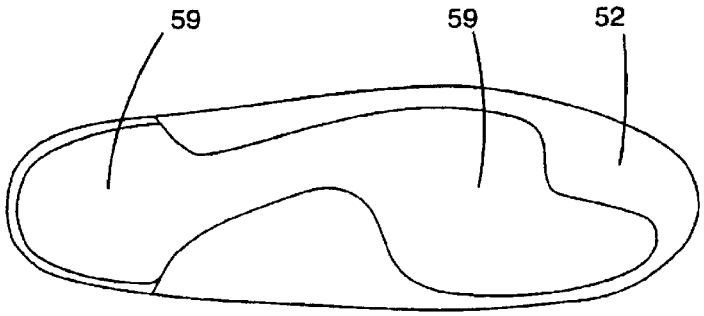
FIG. 7 is a bottom plan view of a footbed according to one embodiment of the invention.

Referring to FIG. 7, which is a bottom plan view of footbed 50, it can be seen that a section of higher density material 59 may be added to the bottom of sole portion 52. Section 59 underlies an area including the big toe, the forefoot planter region, the outer side of the foot and the heel. This area corresponds to area where most of the forces exerted by the foot are channelled. The high density material is almost incompressible and provides a better energy transfer from the foot to shell 20 in the specific area defined by section 59. The bottom surface of footbed 50 can also be provided with an adhesive film adapted to prevent footbed 50 from moving inside shell 20.

Figure 8:
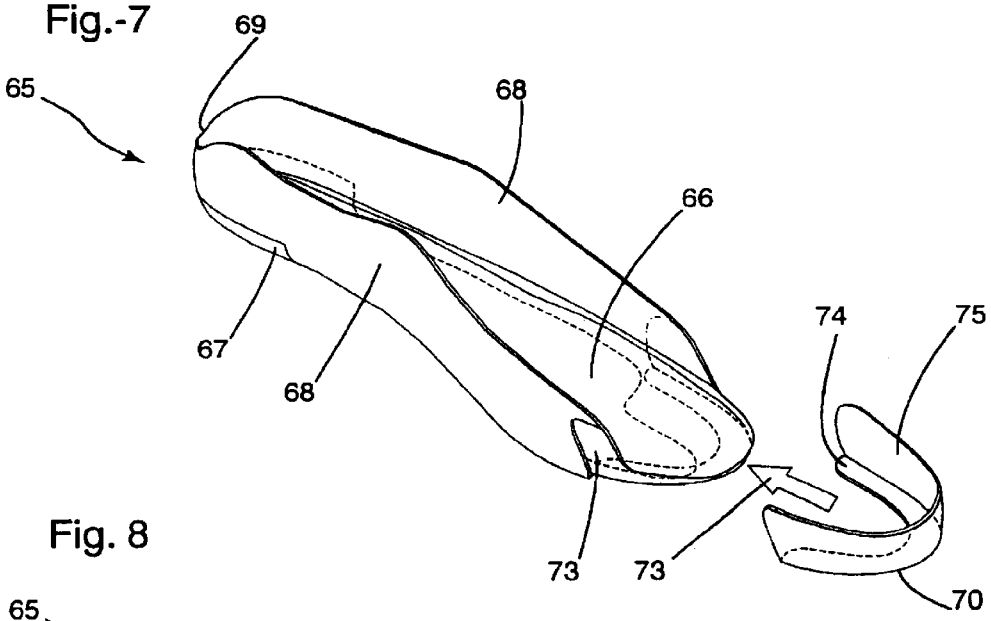
FIG. 8 is a perspective view of a footbed according to a second embodiment of the invention.

FIGS. 8 to 11*b* illustrate a second embodiment of the footbed. There is shown in FIG. 8, a footbed 65 comprising a sole portion 66 and a padding wall 68 extending along both sides of sole 66 and surrounding the heel area 69. Padding wall 68 is high and surrounds and cushions most of the sides of the foot. The outer configuration of footbed 65 is designed to mate with the interior shape of a given shell 20. As shown in FIGS. 8, 11*a* and 11*b*, the outer portion of footbed 65 features a heel portion 67 having sharp edges adapted to properly position footbed 65 into shell 20. In this embodiment, a toe wall insert 70 is provided to close the front portion of footbed 65. A recessed portion 72 is formed into the external surface of footbed 65 to receive and pair up with toe wall insert 70. Toe wall insert 70 has a lower lip 74 and an upper wall 75. Toe wall insert 70 is positioned over the toe front extremity of footbed 65 into recessed portion 72 as indicated by arrow 73, which is also positioned into recessed portion 72. Lower lip 74 is positioned under sole portion 66 and upper wall 75 is positioned into recessed portion 72 on both sides of footbed 65. Footbed 65 and toe wall insert 70 together define the space in which the sides of a foot are enclosed. The combination of these two components provide a complete envelope for the foot.

Figure 9:
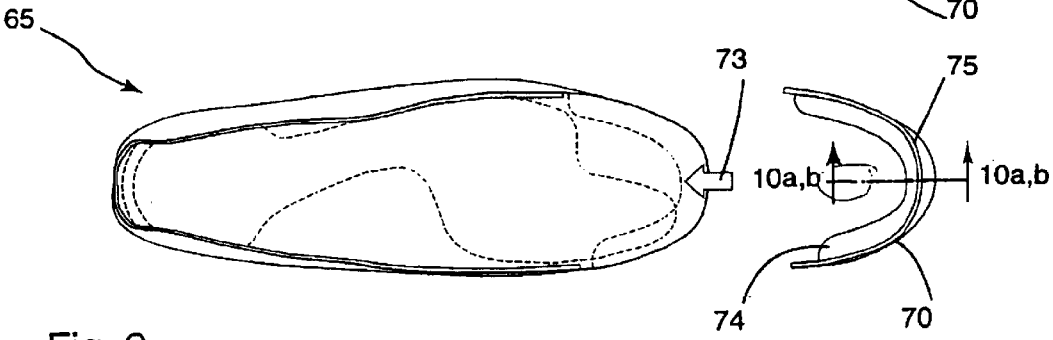
FIG. 9 is a top plan view of the footbed shown in FIG. 8.
Figure 10A:
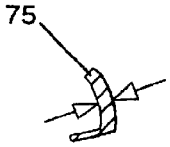
FIGS. 10*a* and 10*b* are cross-sectional view of the footbed shown in FIG. 9 taken at line 10—10.
Figure 10B:
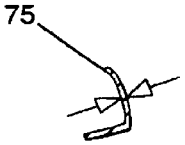

As shown in FIGS. 9, 10*a* and 10*b*, providing toe wall inserts 70 having upper walls of different thicknesses enables the manufacturer to increase or reduce the size of the footwear. FIG. 10*a* shows a thin upper wall 75, which together with footbed 65 defines for example, a size 8½. FIG. 10*b* shows a thicker upper wall 75, which together with footbed 65 defines a size 8. The thicker upper wall 75 shown in FIG. 10*b* reduces the interior space defined by the combination of footbed 65 and toe wail insert 70. By varying the thickness of upper wall 75 it is possible to utilize a shell 20 for two shoe sizes. Furthermore, footbed 65 being exactly the same as footbed 50 shown in FIGS. 3 to 6 except for the added recessed portion 72, the thickness of its padding wall 65 may vary in the same manner as shown in FIGS. 5*a*, 5*b* and 5*c* to accommodate sizes "D", "E", and "EE". Again, with the combinations of three footbeds 65 sizes "D", "E", and "EE", and two toe wall inserts 70 of two different thicknesses, shell 20 may accommodate up to six sizes: two lengths and three widths per length. The versatility of sizes of shell 20 is achieved without compromising the foot and ankle support provided by shell 20. The bottom surface of footbed 65 can also be provided with section 59 of a high density material as shown in FIG. 7 and an anti-skid surface.

FIGS. 11*a* and 11*b* is a side elevation showing toe wall insert being positioned over the front portion of footbed 65. As shown in FIG. 11*b*, the external configuration of the assembly of toe wall 70 with footbed 65 remains constant whether using toe wall insert 70 for a size 8 or a size 8½.

Again, footbed 65 combined with a toe wall insert 70 may be used with a traditionally made skate boot having a specific inner volume. The benefits of using footbed 65 and toe wall 70 are the same. A given skate boot may be used to accommodate up to six sizes.

FIGS. 12 and 13 illustrate a third embodiment of the footbed. A footbed 80 is shown comprising a sole portion 81 and a padding wall 82 extending along both sides of sole 81 and surrounding the heel area 83 and the toe area 84. Padding wall 82 is high and surrounds and cushions most of the sides of the foot. Padding wall 82 in combination with sole portion 81 provides an envelope for the foot which is comfortable yet offers a supporting "bed" that maintains the foot in its required position inside the footwear it is inserted into for optimal performance. The outer configuration of footbed 80 is of course designed to mate with the interior shape of a given shell 20. The outer portion of footbed 80 features a heel portion 85 having sharp edges adapted to properly position footbed 80 into shell 20. In this embodiment, the toe area 84 of footbed 80 is closed by the extension of padding wall 82. As previously described separately, it is now possible with this embodiment to vary the thickness of padding wall 82 along each side of the foot and vary the thickness of the toe area 84 to achieve six shoe sizes for a given shell 20. Six footbed 80 can fit into the receptacle defined by the shell 20 corresponding to two length sizes and three width sizes.

Again, footbed 80 may be used with traditionally made skate boot or footwear having a specific inner volume. The outer configuration of footbed 80 is designed to mate with the interior shape and volume of the traditionally made skate boot and can accommodate up to six sizes of feet for a given upper.

Figure 14:
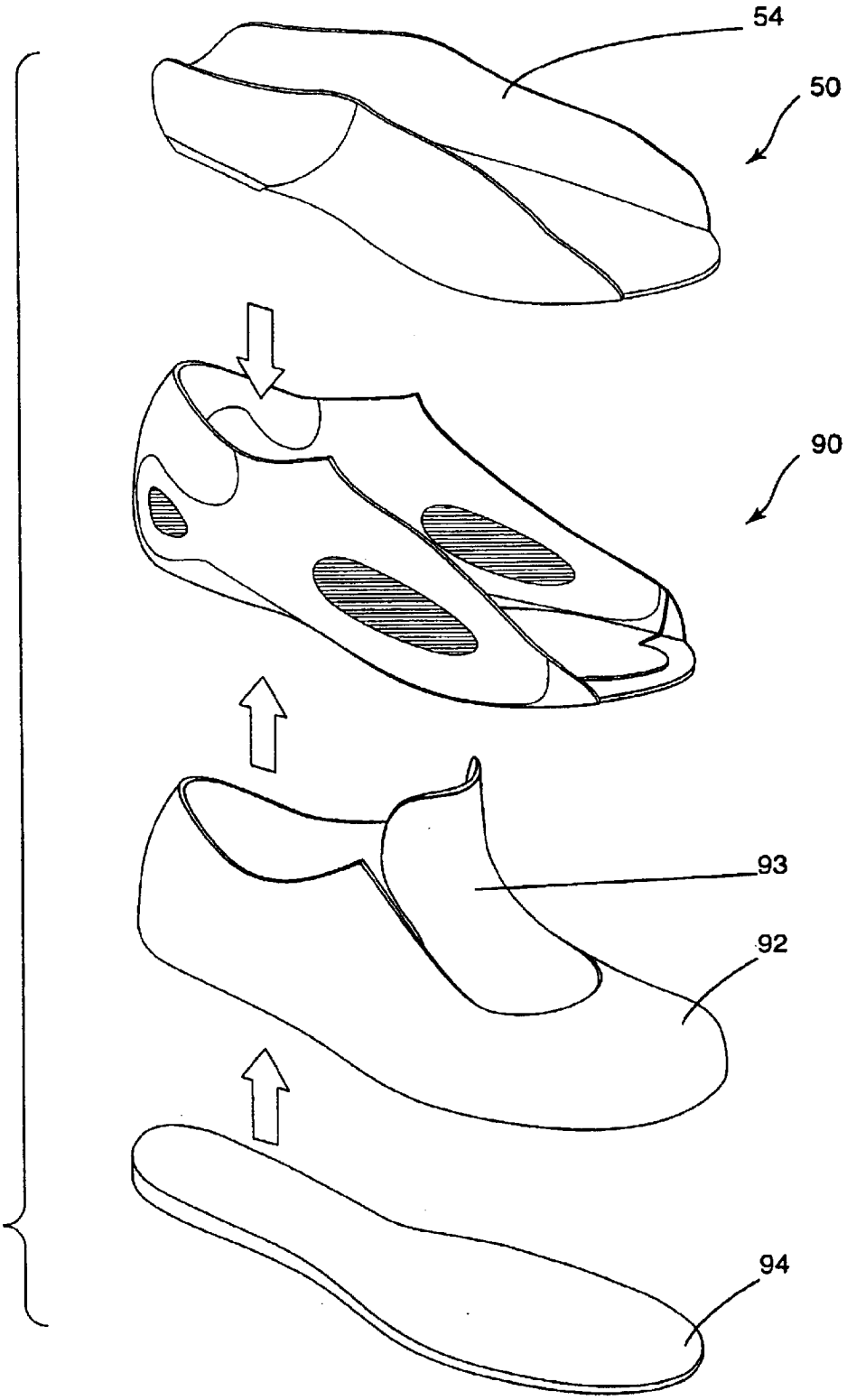
FIG. 14 is an exploded view of a sport footwear in which a footbed, according to one embodiment of the invention, is inserted.

FIG. 14 is an exploded view of an athletic shoe constructed with a molded plastic shell 90 into which is inserted and positioned a footbed 50 as previously described in FIGS. 3 to 6. An outer cover 92 and an outsole 94 are assembled to shell 90 to complete the shoe. In this variant, outer cover 92 has an integral tongue 93 of which the toe portion may vary in thickness to accommodate two length sizes. The thickness of the padding wall 54 of footbed 50 may also vary as previously described to accommodate three width sizes. Of course, it is possible with this shoe construction to utilize any one of the footbeds 50, 65 and 80 previously described to enable a manufacturer to use a single shell 90 for six shoe sizes.

It is also possible to utilize any of footbeds 50, 65 or 80 with a traditionally made footwear having a specific inner volume. The benefits of using the footbed are the same. A given footwear upper may be used to accommodate up to six sizes thereby enabling manufacturer to use a single last to make up to six shoe sizes and simplify the assembly line.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A kit of a plurality of inner footbeds, said kit having at least a first and a second inner footbed, each of said first and second inner footbeds adapted to receive a human foot, the foot having a medial side and a lateral side, a medial line, a plantar surface, and a heel, each of said first and second footbeds also adapted to be inserted in a sport footwear having an outer shell defining a foot-receiving cavity with inner dimensions, each of said first and second inner footbeds comprising:

(a) a sole portion having an upper surface facing the plantar surface of the foot; and (b) a padding wall projecting from said sole portion, said padding wall separating the sides and the heel of the foot from the outer shell of the sport footwear when the footbed is inserted in the foot-receiving cavity of the outer shell of a sport footwear, said padding wall partially cupping the heel and comprising medial and lateral sides facing medial and lateral sides of the foot, said sides extending upwardly from said sole portion up to the medial line of the foot and defining an opening allowing insertion of the foot therein;

each of said first and second inner footbeds having respective outer dimensions generally corresponding to the inner dimensions of the foot-receiving cavity such that each of said first and second inner footbeds fits interchangeably within the same foot-receiving cavity and having different inner dimensions to accommodate feet of different sizes.

2. The kit as defined in claim 1 wherein said padding walls of each of said first and second inner footbeds have different thicknesses to accommodate feet of different sizes.

3. The kit as defined in claim 2 wherein said sole portions of each of said first and second inner footbeds have different thicknesses to accommodate feet of different sizes.

4. The kit as defined in claim 3 wherein said first and second inner footbeds are made of foam material.

5. A combination comprising:

(a) a sport footwear having an outer shell defining a foot-receiving cavity for receiving a human foot having a heel, a plantar surface, a medial side, a lateral side, a medial line, and toes, said outer shell of said sport footwear comprising a bottom portion for facing the plantar surface of the foot, a heel counter for facing the heel of the foot, a medial quarter for facing the medial side of the foot, a lateral quarter for facing the lateral side of the foot, and a toe box for facing the toes of the foot; and (b) a kit of a plurality of inner footbeds, said kit having at least a first and a second inner footbed, each of said first and second inner footbeds:

(i) insertable in said outer shell of said sport footwear, (ii) adapted to receive a human foot, (iii) comprising a sole portion having an upper surface facing the plantar surface of the foot, (iv) comprising a padding wall projecting from said sole portion, said padding wall separating the sides and the heel of the foot from the outer shell of the sport footwear when the footbed is inserted in the foot-receiving cavity of the outer shell of a sport footwear, said padding wall partially cupping the heel and comprising medial and lateral sides facing medial and lateral sides of the foot, said sides extending upwardly from said sole portion up to the medial line of the foot and defining an opening allowing insertion of the foot therein, (v) having respective outer dimensions generally corresponding to the dimensions of the foot-receiving cavity such that each of said first and second inner footbeds fits interchangeably within the same foot-receiving cavity, and (vi) having different inner dimensions to accommodate feet of different sizes.

6. A method of fitting a sport footwear to a customer having a foot of a predetermined size, comprising:

(a) providing an outer sport footwear shell having inner dimensions;

(b) providing a plurality of inner footbeds including at least a first and a second inner footbeds, said first and second inner footbeds having respective outer dimensions generally corresponding to the inner dimensions of said outer sport footwear shell such as to allow each of said first and second inner footbeds to fit interchangeably in said outer sport footwear shell, each of said first and second inner footbeds comprising a sole portion having an upper surface facing the plantar surface of a human foot and a padding wall partially cupping the heel of the foot and comprising medial and lateral sides facing medial and lateral sides of the foot, said sides extending upwardly from said sole portion up to the medial line of the foot and defining an opening allowing insertion of the foot therein, each of said first and second inner footbeds having different inner dimensions such as to accommodate feet of different sizes; and (c) selecting an inner footbed from said plurality of inner footbeds according to the predetermined size of the foot of the customer such that said selected inner footbed accommodates the predetermined size of the foot.

7. The method of fitting a sport footwear to a customer as defined in claim 6 wherein said sport footwear is a skate boot.

8. The method of fitting a sport footwear to a customer as defined in claim 7 wherein said skate boot comprises an ice runner holder assembly.

9. The method of fitting a sport footwear to a customer as defined in claim 8 wherein said first and second inner footbeds comprise respective padding walls having different thicknesses to accommodate feet of different sizes.

10. The method of fitting a sport footwear to a customer as defined in claim 9 wherein said first and second inner footbeds comprise respective sole portions having different thicknesses to accommodate feet of different sizes.

11. The method of fitting a sport footwear to a customer as defined in claim 10 wherein said first and second inner footbeds are made of foam material.

* * * * *